US010826239B1

(12) United States Patent
Chai et al.

(10) Patent No.: US 10,826,239 B1
(45) Date of Patent: Nov. 3, 2020

(54) POP-UP PLUG HAVING A MODULARIZED PLUG SEPARATION MECHANISM

(71) Applicant: NINGBO OUCHUANG ELECTRIC APPLIANCE TECHNOLOGY CO., LTD, Ningbo (CN)

(72) Inventors: Xueke Chai, Ningbo (CN); Shanmin Tian, Ningbo (CN)

(73) Assignee: NINGBO OUCHUANG ELECTRIC APPLIANCE TECHNOLOGY CO., LTD, Ningbo (CN)

( * ) Notice: Subject to any disclaimer, the term of this patent is extended or adjusted under 35 U.S.C. 154(b) by 0 days.

(21) Appl. No.: 16/492,174

(22) PCT Filed: Mar. 7, 2018

(86) PCT No.: PCT/CN2018/078247
§ 371 (c)(1),
(2) Date: Sep. 9, 2019

(87) PCT Pub. No.: WO2018/161909
PCT Pub. Date: Sep. 13, 2018

(30) Foreign Application Priority Data

Mar. 9, 2017 (CN) ..... 2017 1 0136123

(51) Int. Cl.
*H01R 13/635* (2006.01)

(52) U.S. Cl.
CPC ..... *H01R 13/635* (2013.01)

(58) Field of Classification Search
CPC ..... H01R 13/635
See application file for complete search history.

(56) References Cited

U.S. PATENT DOCUMENTS 8,840,418 B2 9/2014 Chien

FOREIGN PATENT DOCUMENTS

| | | | |
|---|---|---|---|
| CN | 103022812 | A | 4/2013 |
| CN | 203119202 | U | 8/2013 |
| CN | 106953206 | A | 7/2017 |
| CN | 106953207 | A | 7/2017 |
| CN | 106953208 | A | 7/2017 |
| CN | 206673222 | U | 11/2017 |
| CN | 206673225 | U | 11/2017 |
| CN | 207038835 | U | 2/2018 |
| KR | 20030087770 | A | 11/2003 |
| WO | 2014100850 | A1 | 7/2014 |

*Primary Examiner* — Ross N Gushi
(74) *Attorney, Agent, or Firm* — Bayramoglu Law Offices LLC

(57) ABSTRACT

A pop-up plug having a modularized plug separation mechanism, includes a plug housing and a plug separation mechanism. The plug separation mechanism includes a sleeve, an ejector pin arranged in the sleeve in a penetrating manner, an ejector pin control mechanism and a first spring for driving the ejector pin to extend out of the plug housing from the side where the insertion sheet is located; the ejector pin control mechanism includes an engaging part arranged at the ejector pin, an engaging head matched with the engaging part to keep the ejector pin in a contracted state, a second spring for driving the engaging head to be engaged with the engaging part, and a button for driving the engaging head to be separated from the engaging part. The sleeve is provided with a holding part connected to an inner cover.

15 Claims, 8 Drawing Sheets

POP-UP PLUG HAVING A MODULARIZED PLUG SEPARATION MECHANISM

CROSS REFERENCE TO THE RELATED APPLICATIONS

This application is the national phase entry of International Application No. PCT/CN2018/078247, filed on Mar. 7, 2018, which is based upon and claims priority to Chinese Patent Application No. 201710136123.1, filed on Mar. 9, 2017, the entire contents of which are incorporated herein by reference.

TECHNICAL FIELD

The present disclosure relates to a plug, in particular to a pop-up plug provided with a modularized plug separation mechanism.

BACKGROUND

Plug is a component configured for cooperating with a socket to draw power into the appliance. The basic structure of the plug includes a plug housing and an insertion sheet (also referred to as an insertion pin) connected to the plug housing. During use, the plug is inserted into the jack of the socket through the insertion sheet and then connected to an insertion sleeve to draw power. In order to ensure a reliable connection between the insertion sleeve and the insertion sheet, the insertion sleeve is designed to be clamped on the insertion sheet by a large clamping force. However, it is inconvenient to pull the plug out without damaging the socket using a single hand and it is necessary to hold the socket with one hand and use the other hand to grab the plug to pull it out. Thus, it needs two hands to pull the plug out when the plug is plugged into a mobile socket. If the clamping force is very large or the user's strength is less, the user has to apply a large pulling force on the plug and meanwhile wiggle the plug from side to side to pull out the plug, which will cause the clamping force of the insertion sleeve in the socket to decrease abnormally and the wall socket to fall off. For this reason, a plug with a separation mechanism is designed. The plug separation mechanism includes a sleeve, an ejector pin arranged in the sleeve in a penetrating manner, an ejector pin control mechanism and a first spring for driving the ejector pin to extend out of the plug housing from the side where an insertion sheet is located; the ejector pin control mechanism includes an engaging part arranged at the ejector pin, an engaging head matching the engaging part to keep the ejector pin in a contracted state, a second spring for driving the engaging head to be engaged with the engaging part, and a button for driving the engaging head to be separated from the engaging part. The existing plug separation mechanism is installed inside the plug housing as discrete parts; when the plug housing is disassembled, the parts of the plug separation mechanism are scattered, causing inconvenience for the user to reassemble or may even cause failure to assemble the plug back to its original state.

SUMMARY

The present disclosure provides a pop-up plug having a modularized plug separation mechanism, which solves the problem that various parts of the existing plug separation mechanism are provided as discrete parts and get scattered after the plug housing is disassembled, resulting in the inconvenience for the user to assemble the plug.

The above technical problem is solved through the following technical solution. A pop-up plug having a modularized plug separation mechanism, includes a plug housing, wherein the plug housing is provided with an insertion sheet, and a plug separation mechanism; wherein the plug separation mechanism includes a sleeve, an ejector pin arranged in the sleeve in a penetrating manner, an ejector pin control mechanism and a first spring for driving the ejector pin to extend out of the plug housing from a side where the insertion sheet is located; the ejector pin control mechanism includes an engaging part arranged at the ejector pin, an engaging head matched with the engaging part to keep the ejector pin in a contracted state, a second spring for driving the engaging head to be engaged with the engaging part, and a button for driving the engaging head to be separated from the engaging part; wherein the sleeve is provided with a holding part, and the holding part is connected to an inner cover; a slide hole is formed between the inner cover and the holding part; the button is slidably connected in the slide hole; the ejector pin is hung in the sleeve; the first spring is located between the ejector pin and the inner cover; the button is connected to the engaging head; the side of the plug housing provided with the insertion sheet is provided with an ejector pin hole for the ejector pin to go through; one end of the button is arranged on a socket housing in a penetrating manner. In the present disclosure, the sleeve and the inner cover constitute a housing for fixing and restricting other components, so that various components can be integrally removed and installed, and the modularized design facilitates the automated production of the plug of the present disclosure and the application in the integrated plug (i.e., a plug having a housing with an integrated structure).

During use, it is assumed that the ejector pin is in a protruding state at an initial state. When the insertion sheet is inserted into the socket, the socket housing squeezes the ejector pin to retract into the plug housing, causing the first spring to store energy; the ejector pin retracts until it contacts the engaging head, and the ejector pin ejects the engaging head and continues to retract, causing the second spring to deform and store energy. After the plug is inserted in place, the ejector pin stops retracting, and at this time the engaging part is aligned with the engaging head (or the engaging part is on a side of the engaging head away from an outer end of the ejector pin, in this state, the ejector pin may protrude out under an action of the first spring); under an action of the second spring, the engaging head extends to the engaging part to lock the ejector pin so that the ejector pin does not extends outward. When the plug needs to be pulled out, the button is pressed for driving the engaging head to be separated from the engaging part, and the second spring stores energy; under the action of the first spring, the ejector pin pops up to produce a compressing force acting on the socket housing, and the socket generates a reaction force against the ejector pin, and the reaction force acts to pull the plug out of the socket, thereby saving labor when the plug is pulled out.

Preferably, the inner cover is provided with a limit pin arranged in an end of the first spring away from the ejector pin in a penetrating manner, which can reduce the possibility of axial bending of the first spring when squeezed.

Preferably, the engaging head and the button are distributed on both sides of the ejector pin in a radical direction. When the plug housing is flat, the layout is convenient, and three-pole plugs are mostly flat.

Preferably, the ejector pin control mechanism further includes a barb and a hook part disposed on the ejector pin and matched with the barb. The engaging head and the barb are distributed on two sides of the ejector pin. The barb is hinged on the plug housing or the sleeve, and swings when driven by the button. This provides a new technical scheme of the ejector pin engaging mechanism.

Preferably, the engaging head is fixed to the button, and when the button is pressed, the engaging head performs a translational movement. If the engaging head is engaged with or disengaged from the engaging part in a swinging manner, it is not only inconvenient to arrange it in the plug, but also because the torque generated by the first spring against the engaging head is not zero, when the engaging head is engaged onto the engaging part, the second spring has to be designed as a spring with a large elastic force.

Preferably, there are two ejector pin control mechanisms; the buttons of the two ejector pin control mechanisms are distributed on both sides of the ejector pin; the two ejector pin control mechanisms share the second spring. The structure is compact and saves energy when the two ejector pin control mechanisms are driven.

Preferably, an inner end of the button of one of the two ejector pin control mechanisms is provided with a slide slot extending from an inner end face in a pressing direction of the button, and an inner end of the button of the other ejector pin control mechanism is slidably connected in the slide slot. The second spring is located in the slide slot and extends along an extending direction of the slide slot; and two ends of the second spring are respectively connected to the buttons of the two ejector pin control mechanisms.

Preferably, an inner end of the ejector pin is provided with a spring installation hole extending along an extending direction of the ejector pin, and the first spring is arranged in the spring installation hole in a penetrating manner. This can maximize the use of space in a height direction of the plug (the height direction of the plug is an extending direction of the insertion sheet), thereby reducing the height of the product and increasing the installation space of the spring.

Preferably, an L-pole on/off control switch is disposed inside the plug housing. The L-pole on/off control switch includes a first contact point, a second contact point, a commutator block, a permanent magnet and a conductive block slidably connected between the first contact point and the second contact point. The conductive block is connected to the second contact point by a conductive spring. The conductive block is hinged to a conductive arm. The first contact point is connected to an L-pole insertion sheet in the insertion sheet. The second contact point is used to lead the power cord to the plug from power source. The permanent magnet is used to attach the conductive arm to the first contact point. The conductive arm is also connected to the ejector pin by a cable supported on the commutator block. When the engaging head is engaged with the engaging part, the conductive arm is connected to the first connect point. When the ejector pin moves toward the outside of the plug housing from the position fixed by the engaging head matched with the engaging part, the ejector pin pulls the conductive arm away from the first contact point by the cable. In the process of inserting the existing plug into the socket, the electricity is drawn into the appliance connected to the plug as long as the insertion sheet contacts the insertion sleeve of the socket, but the insertion sheet needs to move by a certain distance and time on the socket before it is inserted in place or pulled out. This process of insertion and extraction will sometimes lead to a sparking between the insertion sheet of plug and the insertion sleeve of socket. The longer the sparking time, the more likely it is to have adverse consequences (such as increasing contact resistance and igniting surrounding combustible materials). This technical solution can shorten the sparking time. When the plug is inserted into the socket, if the ejector pin does not fully retract to the position fixed by the engaging part matched with the engaging head, the conductive arm is disconnected from the first contact point by the cable (i.e., the insertion or extraction action). So, although the L-pole insertion sheet is in contact with the insertion sleeve, the electricity cannot flow through the electric wire of the plug to form a circuit through the electric appliance, thus no sparking is caused. When the plug is inserted in place, the ejector pin retracts to the position where the engaging part is engaged with the engaging head; at the same time, the cable cannot separate the conductive arm from the first contact point, and the conductive arm is in contact with the first contact point under the action of the permanent magnet, so that the first contact point and the second contact point are conductive, that is, the electricity can flow through the plug. When the plug is pulled out, the button is driven to disengage the engaging head and the engaging part, the first spring drives the ejector pin to extend out, and during the extension of the ejector pin, the conductive arm and the first contact point are pulled apart by the cable to realize a power cut. The conductive arm is not directly disposed on the second contact point, but is designed on the slidable conductive block, and then the conductive block is connected to the second contact point through the conductive spring, which can improve the convenience in production. If the conductive arm and the second contract are connected directly, it will require a higher length accuracy of the cable, causing the difficulty to increase the production. This solution can compensate for the difference in length of the cable by the expansion and retraction of the conductive spring.

The present disclosure also includes an ejector pin fixed assist mechanism, and the ejector pin fixed assist mechanism includes a pin hole of the ejector pin part arranged on the ejector pin, a pin hole of the housing part arranged on the plug housing, a fixed pin in the pin hole of the housing part, a magnet driving the fixed pin to move into the pin hole of the housing part, an electromagnet driving the fixed pin to move into the pin hole of the ejector pin part after overcoming the magnetic force of the magnet and a button switch. The button switch is a normal closed switch. The electromagnet, the button switch and the L-pole on/off control switch are connected in series between the L-pole and the N-pole of the insertion sheet. The button is provided with an ejector head that drives the button switch to disconnect when the button switch is pressed. When the ejector pin is fixed by the engaging head engaged with the engaging part, the pin hole of the ejector pin part is aligned with the pin hole of the housing part. A depth of the pin hole of the ejector pin part is less than a length of the fixed pin, and a depth of the pin hole of the housing part is greater than a length of the fixed pin. The ejector pin fixed assist mechanism can not only reliably fix the ejector pin when the ejector pin is in a retracted position to reduce the force on the engaging head and prevent the damage of the engaging head, but also disengage as long as the ejector pin disengages, without affecting the ejector pin to pop up.

The present disclosure has the following advantages. The plug can be easily pulled out with one hand, without the need to press the socket with the other hand. For average persons, the convenience is greatly improved; while for disabled people with only one hand, this product will be the inevitable choice. The modularized design facilitates the automated production of the present disclosure and the application in the integrated plug (i.e., the plug having a housing with an integrated structure). In the preferred solution, it is convenient to realize that the engaging head is engaged or disengaged with the engaging part by means of translational motion.

Figure 1:
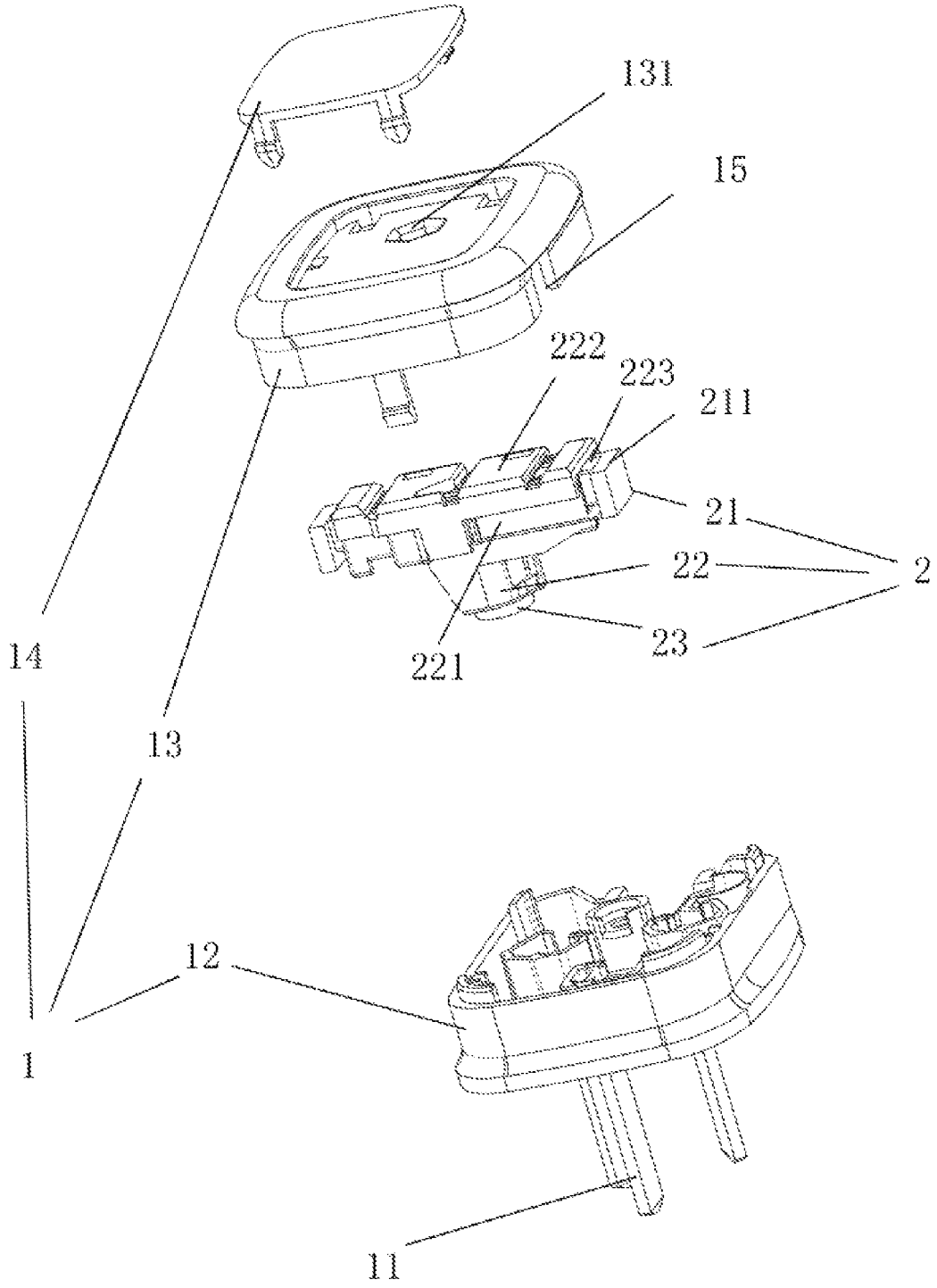
FIG. 1 is a schematic diagram of Embodiment 1 of the present disclosure.

In the figures: plug housing 1, insertion sheet 11, L-pole insertion sheet 11-1, N-pole insertion sheet 11-2, E-pole insertion sheet, first half part 12, ejector pin hole 121, second half part 13, nut limit hole 131, baffle plate 14, button avoidance hole 15, engaging slot 16, bolt 17, nut 18, plug separation mechanism 2, ejector pin control mechanism 21, button 211, bulge 2211, engaging part 212, engaging head 213, second spring 214, slide slot 215, hook part 216, barb 217, hinge shaft 218, sleeve 22, holding part 221, inner cover 222, slide hole 223, limit pin 224, suspended step 225, ejector pin 23, spring installation hole 231, avoidance ring 232, first spring 24, inner first spring 241, outer first spring 242, L-pole on/off control switch 3, first contact point 31, second contact point 32, commutator block 33, permanent magnet 34, conductive block 35, connection point 36 between cable and ejector pin, conductive spring 37, conductive arm 38, cable 39, ejector pin fixed assist mechanism 4, pin hole 41 of ejector pin part, pin hole 42 of housing part, fixed pin 43, magnet 44, electromagnet 45, button switch 46, ejector head 47.

DETAILED DESCRIPTION OF THE EMBODIMENTS

The present disclosure will be further described below in conjunction with specific drawings and embodiments.

In embodiment 1, as shown in FIG. 1, a pop-up plug having a modularized plug separation mechanism includes the plug housing 1 and the plug separation mechanism 2.

The plug housing 1 is provided with the insertion sheet 11, and the number of insertion sheets 11 depends on the number of poles in the plug. If it is a two-pole plug, it has two insertion sheets, and if it is a three-pole plug, it has three insertion sheets. The plug housing 1 is an integral type or a split type. The present embodiment shows a split type three-pole plug, in which the plug housing 1 includes the first half part 12 and the second half part 13. The insertion sheet 11 is connected to the first half part 12. The first half 12 and the second half 13 are fixed together by a bolt passing through the first half part 12 and then are screwed onto the nut located in the nut limit hole 131 of the second half part 13. The second half part 13 is further provided with the baffle plate 14. The baffle plate 14 is used to shield the nut limit hole 131. An abutment between the first half part 12 and the second half part 13 is provided with the button avoidance hole 15.

The plug separation mechanism 2 includes the ejector pin control mechanism 21, the sleeve 22 and the ejector pin 23 arranged in the sleeve in a penetrating manner. There are two ejector pin control mechanisms 21. The two ejector pin control mechanisms 21 are distributed on both sides of the ejector 23. The ejector pin control mechanism 21 includes the button 211. One end of the sleeve 22 is provided with the holding part 221. There are two holding parts 221. The two holding parts 221 are distributed on both sides of the sleeve 22. The holding part 221 is connected to the inner cover 222. The slide hole 223 is formed between the inner cover 222 and the holding part 221. The button 221 is slidably connected in the slide hole 223 to make the button 211 slidably connected to the holding part 221.

Figure 2:
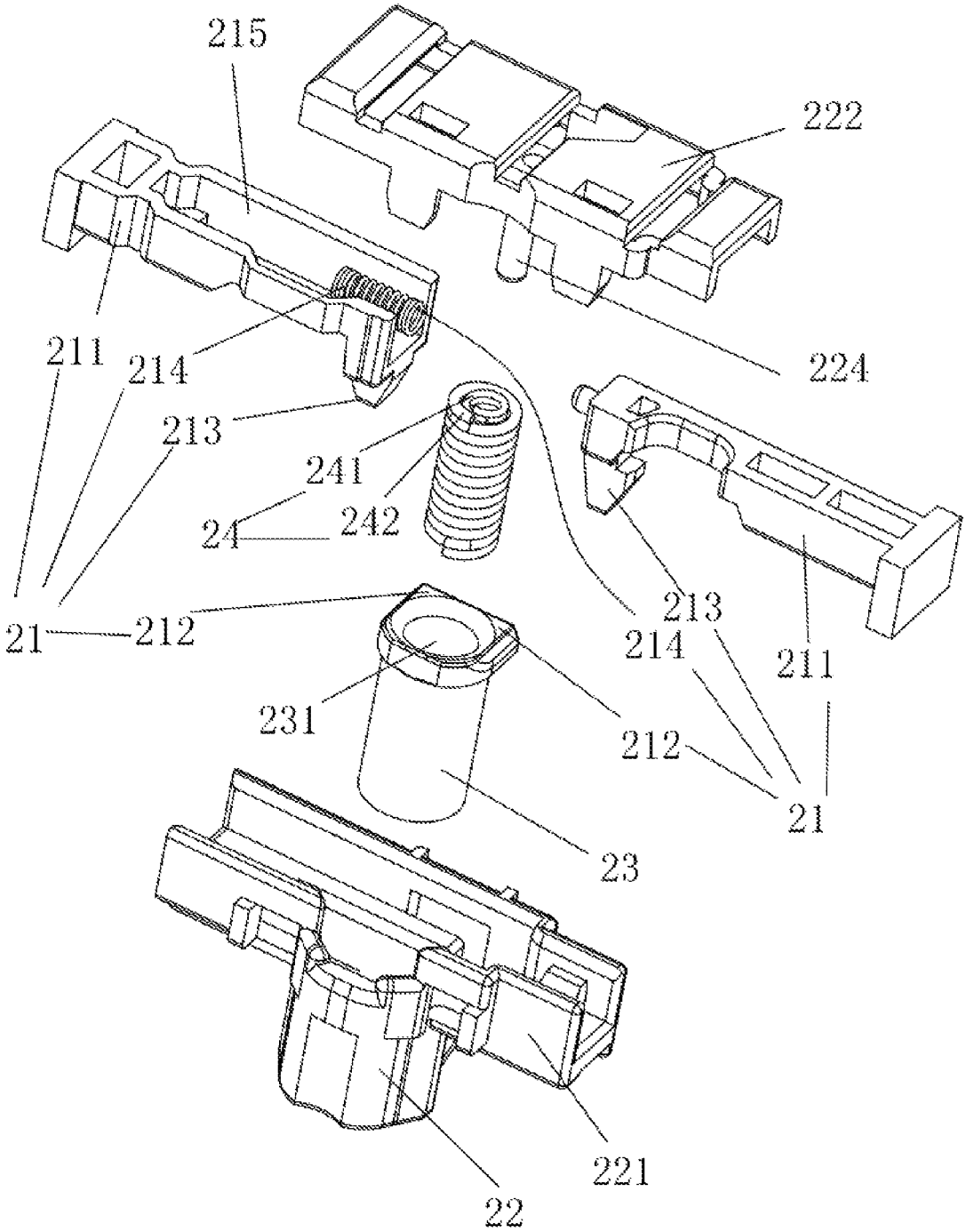
FIG. 2 shows an explosive view of a plug separation mechanism.

As shown in FIG. 2, the plug separation mechanism 2 also includes the first spring 24. The first spring 24 includes the inner first spring 241 and the outer first spring 242. The outer first spring 242 is sleeved on the inner first spring 241. An inner end of the ejector pin 23 is provided with the spring installation hole 231 extending along an extending direction of the ejector pin. The inner cover 222 is provided with the limit pin 224. The ejector pin control mechanism 21 also includes the engaging part 212, the engaging head 213 which matches the engaging part to make the ejector pin remains in a contracted state, and the second spring 214 for driving the engaging head 213 to be engaged with the engaging part. The engaging part 212 is arranged on an outer surface of a top end of the ejector pin 23. The engaging part 212 is a protruding structure. The engaging head 213 is integrally formed with the button 211 to form into one piece. The two ejector pin control mechanisms 21 share the second spring 214.

An inner end of the button of the left ejector pin control mechanism of the two ejector pin control mechanisms 21 is provided with the slide slot 215 extending from an inner end face in a pressing direction of the button.

Figure 3:
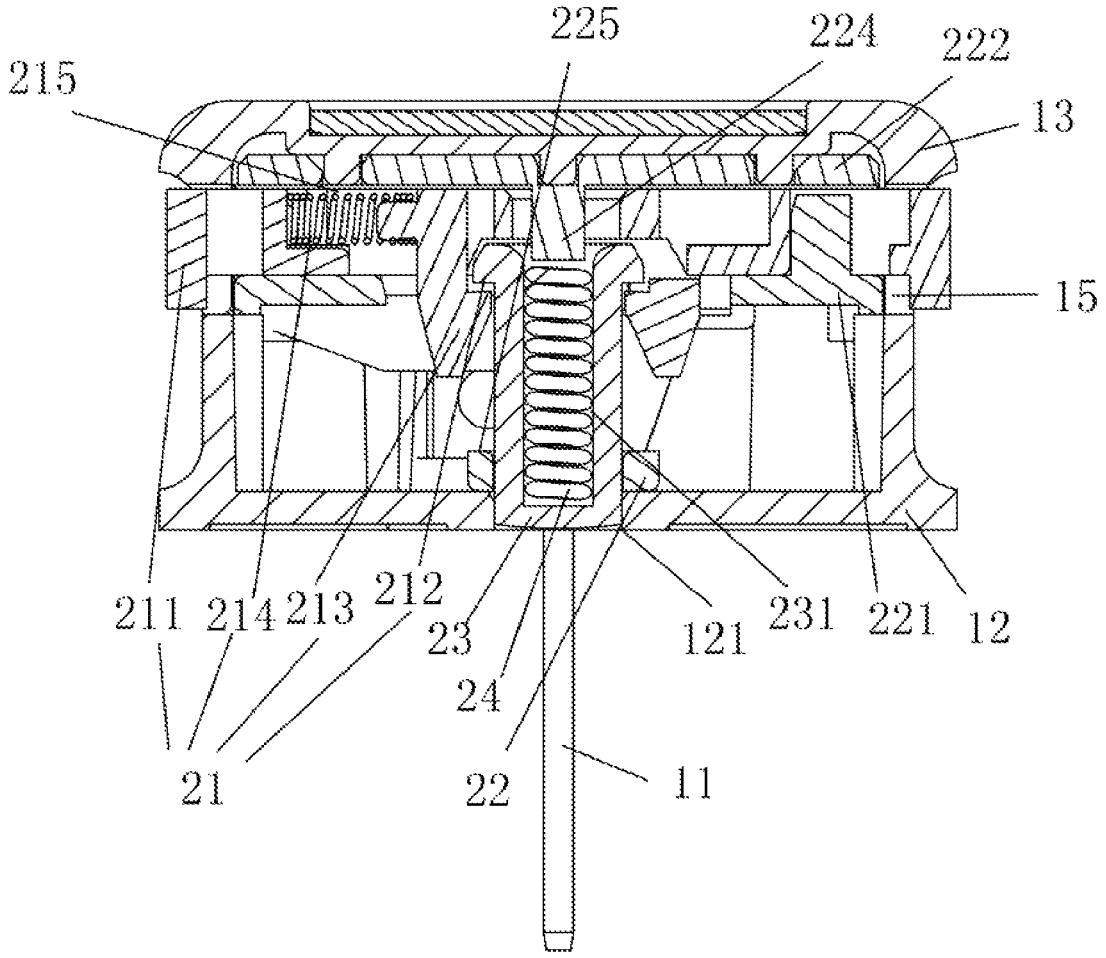
FIG. 3 is a schematic diagram of a use state of Embodiment 1 of the present disclosure.

The method of assembling the present disclosure is:

As shown in FIG. 3, an inner surface of an outer end of the sleeve 22 is provided with the suspended step 225. When the ejector pin 23 extends out to the engaging part 212 and hooks on the suspended step 225, the ejector pin 23 cannot continue to move outwards and is suspended within the sleeve 22.

The ejector pin 23 is arranged in the sleeve 22 in a penetrating manner. The first spring 24 is arranged in the spring installation hole 231 of the ejector pin 23 in a penetrating manner. The button of the left ejector pin control mechanism of the two ejector pin control mechanisms 21 is shelved on the holding part 21. The engaging head 213 is located on the right side of the ejector pin and is matched with the engaging part 212 located on the right side. The second spring 214 is shelved in the slide slot 215. The button of the right ejector pin control mechanism is shelved in the slide slot 215 to achieve being shelved in the holding part, and its engaging head is located on the left side of the ejector pin and is matched with the engaging part located on the left side. Two ends of the second spring 214 are respectively connected to the buttons of the two ejector pin control mechanisms. Then, the inner cover 222 is engaged to the holding part 221, and the limit pin 224 is arranged in an end of the first spring 24 away from the ejector pin in a penetrating manner. So far, the assembly of the plug separation mechanism 2 is completed, and the plug separation mechanism 2 forms a module where various parts are connected together.

Then, the plug separation mechanism is installed inside the plug housing 1 in such a manner that the ejector pin 23 is aligned with the ejector pin hole 121 located on the first half part 12. Finally, the first half part 12 and the second half part 13 are re-fixed together. After assembly, the button 211 extends out of the plug housing 1 through the button avoidance hole 15 on the plug housing.

The process of pulling the plug of the present disclosure from the socket is: the buttons 211 of the two eject pin control mechanisms 21 are pressed, and the button 211 generates a retracting translational movement. When the button moves, the engaging head 23 is driven to move in the same direction along with the button, and at the same time the second spring 214 is squeezed to cause the second spring to store energy. The engaging head 213 is detached from the engaging part 212, and the first spring 24 releases energy to drive the ejector pin 23 to extend from the first half part 12. The result of the extension is to squeeze the socket housing, and the socket housing exerts a reaction force on the ejector pin 23 to cause the insertion sheet 11 to be pulled out of the socket.

Figure 4:
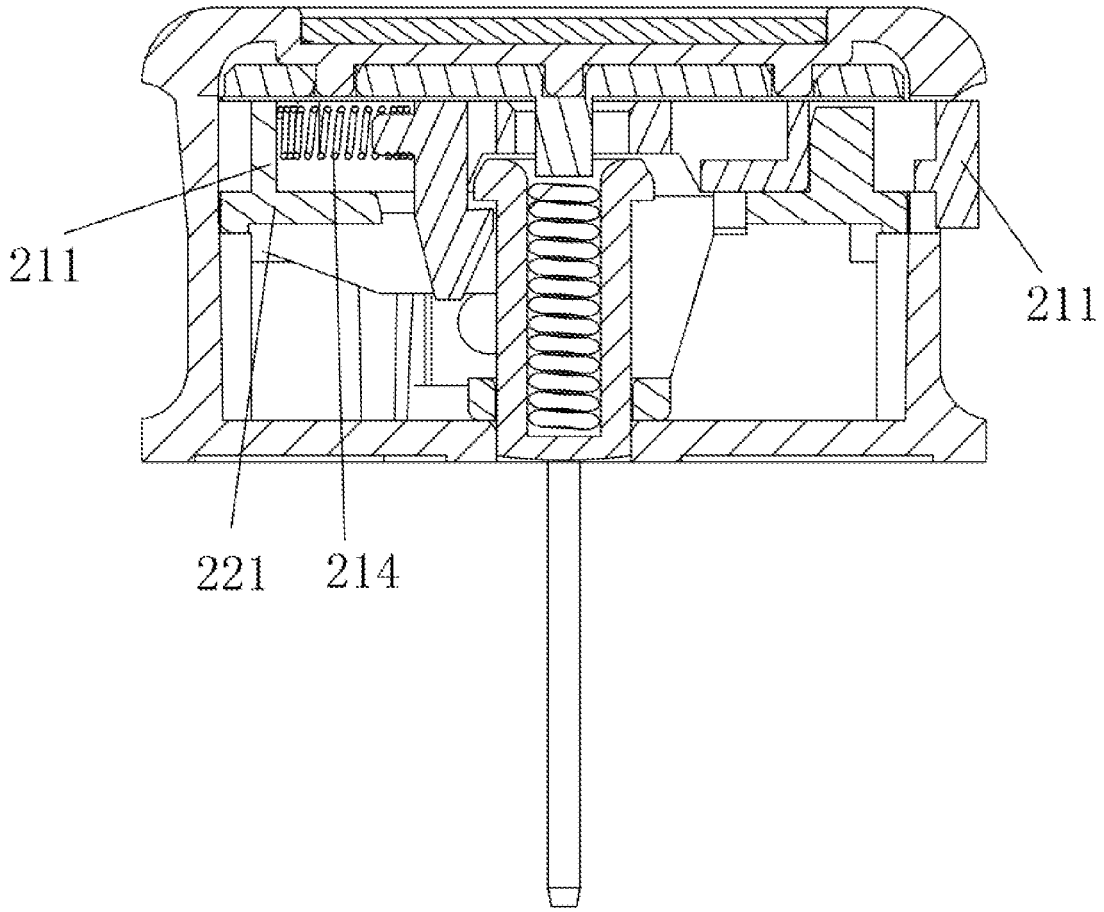
FIG. 4 is a schematic diagram of Embodiment 2 of the present disclosure.

Embodiment 2 differs from the embodiment 1 in that:

As shown in FIG. 4, there is only one ejector pin control mechanism 21. In this case, one end of the second spring abuts against the button 211, and the other end abuts against the bulge 2211 on the holding part 221.

Figure 5:
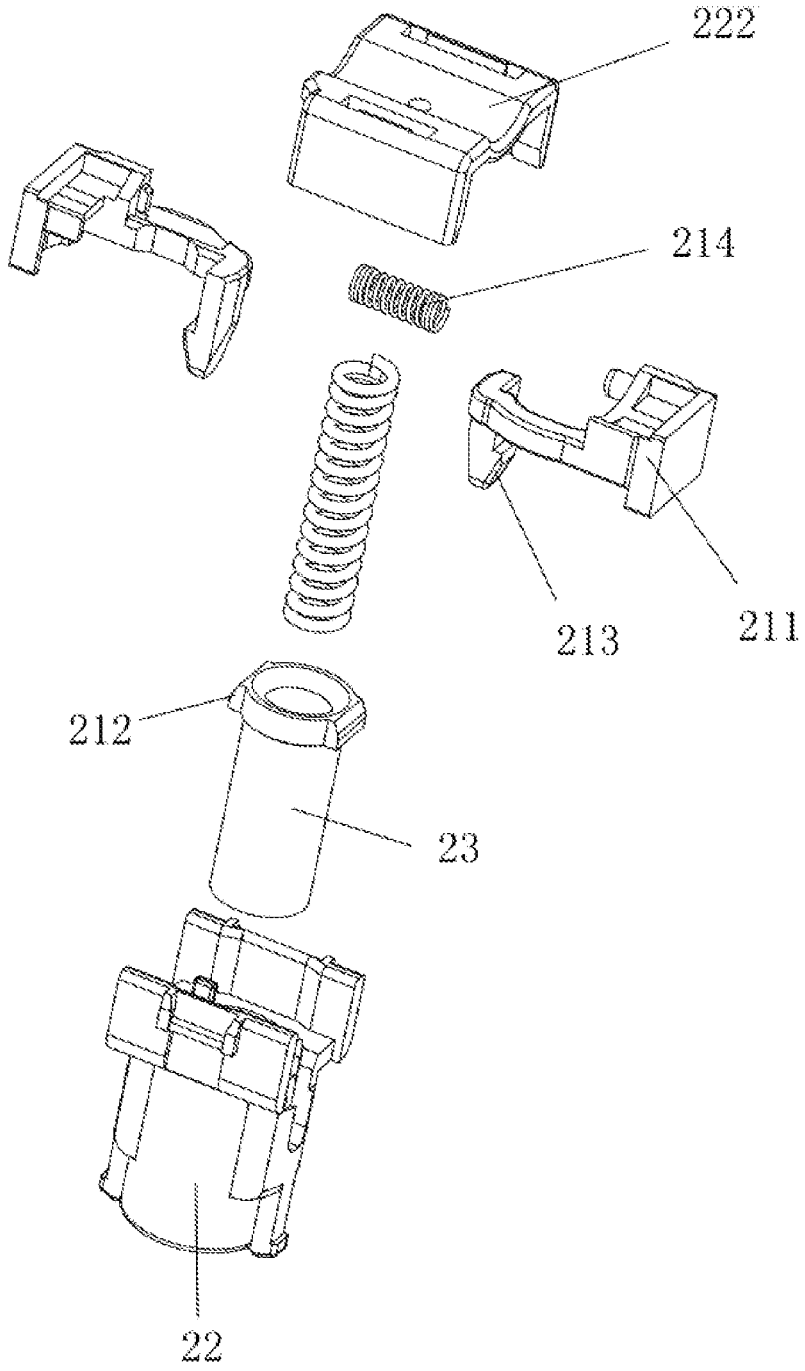
FIG. 5 shows an explosive view of the plug separation mechanism of Embodiment 3 of the present disclosure.

Embodiment 3 differs from the embodiment 1 in that:

As shown in FIG. 5, the buttons 211 of the two ejector pin control mechanisms 21 are spliced together in a direction perpendicular to the expansion and retraction of the first spring 24. In embodiment 1, they are spliced together along the direction of expansion and retraction of the first spring. Of course, this embodiment may also adopt only one ejector pin control mechanism as in embodiment 2.

Figure 6:
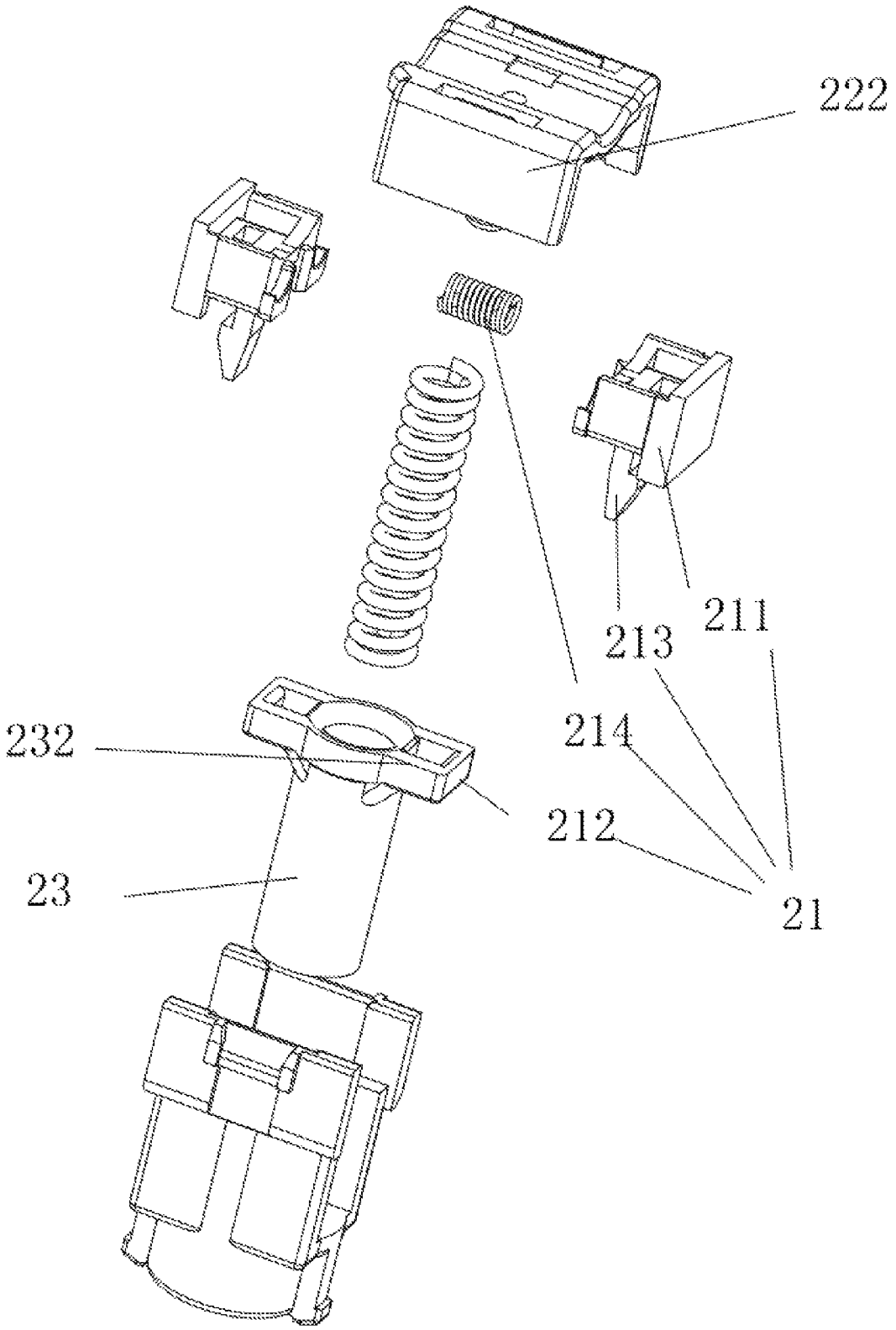
FIG. 6 shows an explosive view of the plug separation mechanism of Embodiment 4 of the present disclosure.

Embodiment 4 differs from the embodiment 3 in that:

As shown in FIG. 6, the button 211, the engaging part 212 and the engaging head 213 of the same ejector pin control mechanism 21 are located on a side of the ejector pin 23. The specific design method of the engaging part 212 is that an avoidance ring 232 is set on the ejector pin 23, and one side wall of the avoidance ring 232 constitutes the engaging part 212. When assembled, the engaging head 213 is arranged in the avoidance ring 232 in a penetrating manner to cooperate with the engaging part.

Figure 7:
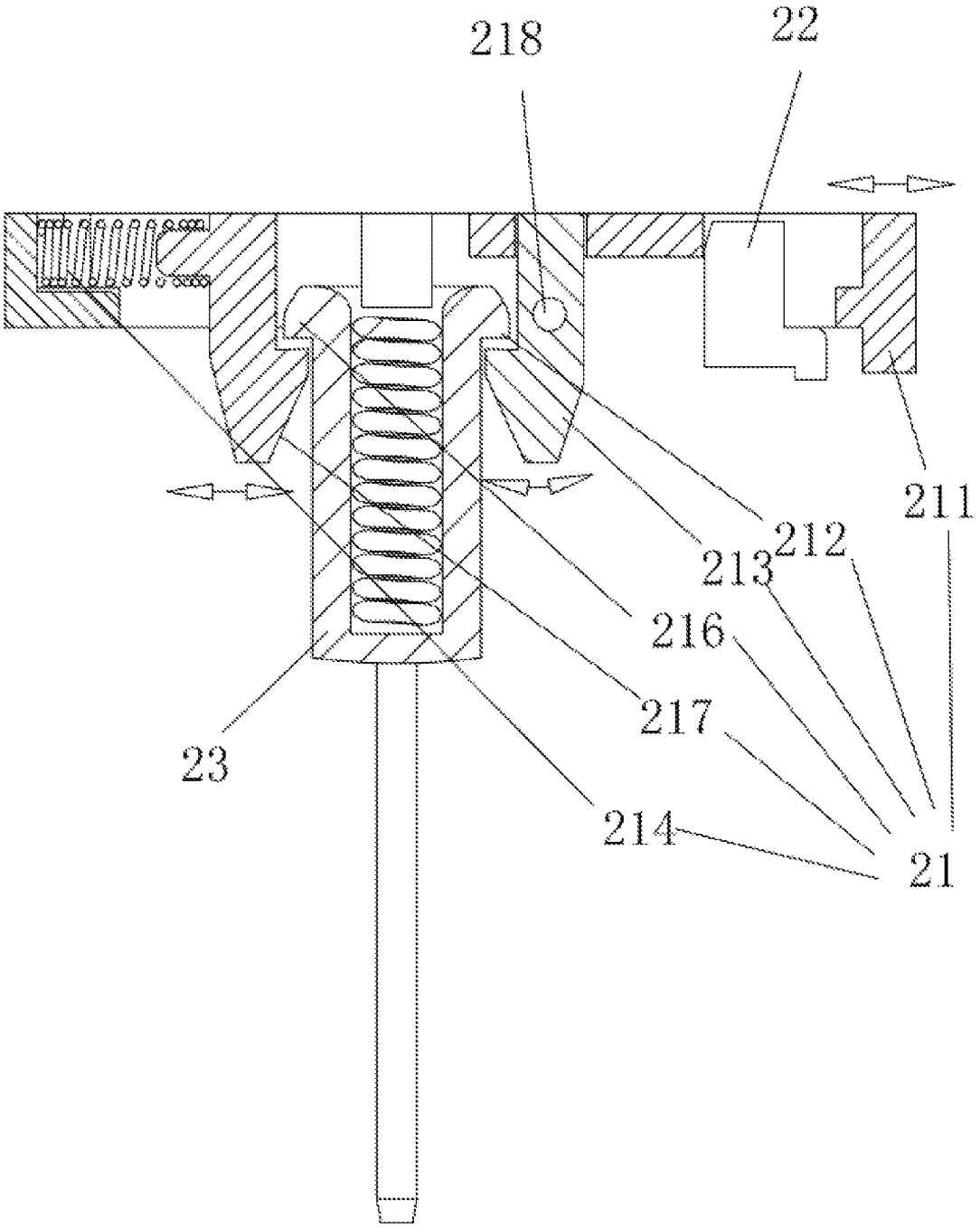
FIG. 7 is a schematic diagram of Embodiment 5 of the present disclosure.

Embodiment 5 differs from the above embodiments in that:

As shown in FIG. 7, although only one ejector pin control mechanism 21 is set up, the ejector pin control mechanism 21 also includes the barb 217 and the hook part 216 matched with the barb. The hook part 216 is arranged on the ejector pin 23. The engaging head 213 and the barb 217 are distributed on two sides of the ejector pin 23. The barb 217 is hinged to the sleeve 22 by the hinge shaft 218 and swings after being driven by the button.

In this embodiment, the engaging head and the button are on the same side of the ejector pin, and the barb and the button are on the two sides of the ejector pin. Of course, it can also be designed such that the engaging head and the button are on both sides of the ejector pin, and the barb and the button are on the same side of the ejector pin.

Figure 8:
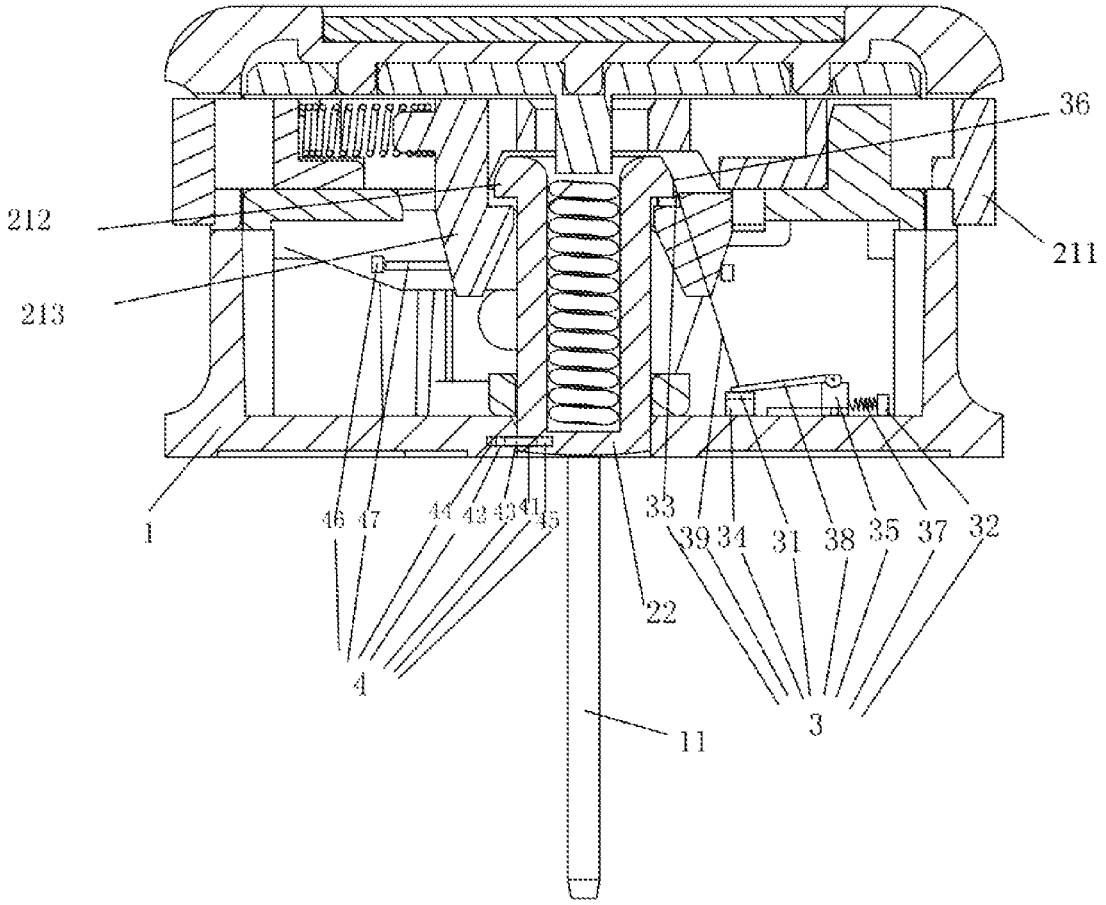
FIG. 8 is a structural schematic diagram of Embodiment 6 of the present disclosure.
Figure 9:
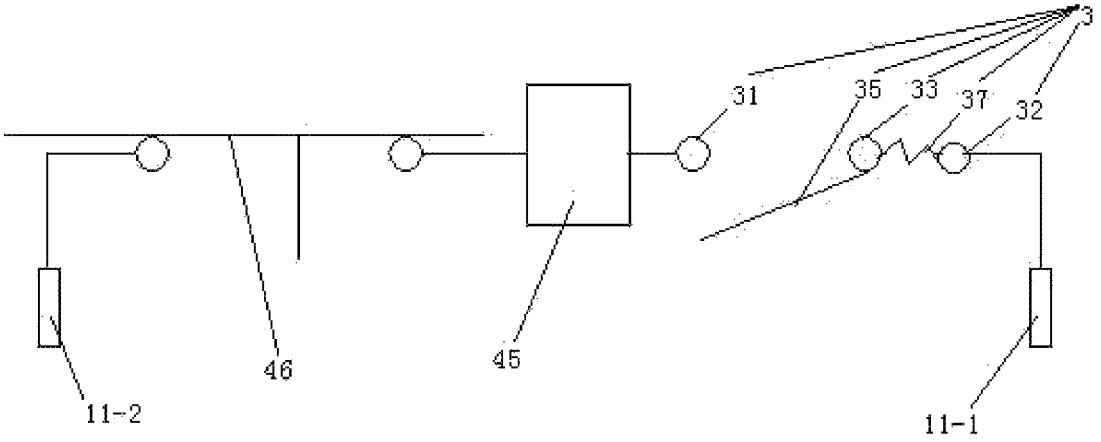
FIG. 9 shows a control circuit diagram of an electromagnet.

Embodiment 6 differs from the above embodiments in that: on the basis of the above various embodiments, the following structures are added:

As shown in FIG. 8 and FIG. 9, the plug housing 1 is provided with the L-pole on/off control switch 3 and the ejector pin fixed assist mechanism 4. The insertion sheet of the two-pole plug has the L-pole insertion sheet and the N-pole insertion sheet, and the three-pole plug has the L-pole insertion sheet, the N-pole insertion sheet and the E-pole insertion sheet.

The L-pole on/off control switch 3 includes the first contact point 31, the second contact point 32, the commutator block 33, the permanent magnet 34 and the conductive block 35. The first contact point 31 is connected to the L-pole insertion sheet in the insertion sheet 11. The second contact point 32 is connected to the terminal of the power supply line L of the plug, or the second contact point itself can be the terminal. The commutator block 33 is fixed on the plug housing 1. The commutator block 33 and the connection point 36 between the cable and the ejector pin are located in the same straight line, perpendicular to the extending direction of the ejector pin. The conductive block 35 is slidably connected inside the plug housing along the distributing direction of the first point and the second contact point. The conductive block 35 is located between the first contact point 31 and the second contact point 32. The conductive block 35 is connected to the second contact point 32 by the conductive spring 37 to achieve electrical conduction. The conductive spring 37 is a tension spring. The conductive block 35 is hinged to the conductive arm 38. The conductive arm 38 is connected to the ejector pin 23 through the cable 39. When the engaging head 213 is engaged with the engaging part 212, the permanent magnet 34 generates a magnetic force acting on the conductive arm 38 to make the conductive 38 abut against the first contact point 31, thus realizing electrical conduction. In this embodiment, the length of the cable meets the requirement that the first contact point and the conductive arm are conductive only when the engaging head 213 is engaged to the engaging part 212. At this time, the L-pole insertion sheet is conductive through the first contact point 31, the conductive arm 38, the conductive block 35, the conductive spring 37 and the second contact point 32, so that electricity flows into the electrical appliance with the plug of the present disclosure.

When the button 211 is pressed to disengage the engaging head 213 and the engaging part 212, the ejector pin 23 extends out of the plug housing 1 to generate a displacement toward the outside of the plug housing, and when the ejector pin 12 moves, the conductive arm 38 is pulled to rotate by the cable 39 to be separated from the first contact point 31, making it impossible for electricity to flow out through the L-pole insertion sheet. In this process, if the length of the cable is insufficient to interfere with the output of the ejector pin, the deformation of the conductive spring 37 can compensate for the shortage of the cable length.

The ejector pin fixed assist mechanism 4 includes the pin hole 41 of ejector pin part, the pin hole 42 of housing part, the fixed pin 43, the magnet 44, the electromagnet 45 and the button switch 46. The pin hole 41 of the ejector pin part is arranged on the ejector pin 23. The depth of the pin hole 41 of the ejector pin part is less than the length of the fixed pin 43. The pin hole 42 of the housing part is arranged on the plug housing 1. The depth of the pin hole 42 of the housing part is greater than the length of the fixed pin 43. When the ejector pin 23 is fixed by the engaging head 213 engaged with the engaging part 212, the pin hole 41 of the ejector pin part is aligned with the pin hole 42 of the housing part. The fixed pin 43 is located in the pin hole 42 of the housing part. The electromagnet 45 is arranged on the ejector pin 23, which is used to adsorb the fixed pin 43 to make the fixed pin 43 move towards the ejector pin. The fixed pin 44 is fixed in the plug housing 1, which is used to drive the fixed pin 43 to retract into the pin hole 42 of the housing part. The magnetic force generated by the electromagnet 45 on the fixed pin 43 is greater than the magnetic force generated by the magnet 44 on the fixed pin 43. The button switch 46 is a normal closed switch. The button 211 is provided with the ejector head 47. When the button 211 is pressed to drive the engaging head 213 to disengage from the engaging part 212, the ejector head 47 presses a pressing head of the button switch 46 to cause the button switch 46 to be disconnected. When the button 211 is reset, the ejector head 47 does not act on the button switch 46 and the button switch 46 gets reset.

The electromagnet 45, the button switch 46 and the L-pole on/off control switch 3 are connected in series between the L-pole insertion sheet 11-1 and the N-pole insertion sheet 11-2 of the insertion sheet 11.

When the ejector pin 23 is fixed by the engaging head 213 engaged with the engaging part 212, the pin hole 41 of the ejector pin part is aligned with the pin hole 42 of the housing part. At the same time, the ejector head 47 cannot press the button switch 46, the button switch 46 is in a closed state, the ejector pin fixed assist mechanism 4 is also in a closed state, and the electromagnet 45 is energized. The attraction force generated by the electromagnet 45 overcomes the attraction force generated by the magnet 44 to make the fixed pin 43 be inserted into the pin hole 41 of the ejector pin part. The length of the fixed pin is greater than the depth of the pin hole 41 of the ejector pin part, so the fixed pin is also partially inserted in the pin hole 42 of the housing part, and the fixed pin 43 fixes the ejector pin 23 and the plug housing 1 together to assist the engaging head to be engaged with the engaging part for fixing. When the button 211 is pressed to make the ejector pin 23 to extend, the button 211 presses the button switch 46 by the ejector head 47 to make the button switch be disconnected, making the electromagnet 45 to be deenergized and lose adsorption function. At the same time, the attraction force of the magnet 44 causes the fixed pin to completely retract into the pin hole 42 of the housing part. The first spring ejects the ejector pin, and when the ejector pin is ejected the ejector pin fixed assist mechanism 4 is also disconnected, even if the button releases the electromagnet, there is no electricity, thereby reducing the wear between the fixed pin and the ejector pin.

What is claimed is:

1. A pop-up plug having a modularized plug separation mechanism, comprising: a plug housing, wherein the plug housing is provided with an insertion sheet a plug separation mechanism, wherein the plug separation mechanism comprises a sleeve, an ejector pin arranged in the sleeve in a penetrating manner, at least one ejector pin control mechanism and a first spring for driving the ejector pin to extend out of the plug housing from a side where the insertion sheet is located; the at least one ejector pin control mechanism comprises an engaging part arranged at the ejector pin, an engaging head matched with the engaging part to make the ejector pin remain in a contracted state, a second spring for driving the engaging head to be engaged with the engaging part, and a button for driving the engaging head to be separated from the engaging part, wherein the sleeve is provided with a holding part, and the holding part is connected to an inner cover; a slide hole is formed between the inner cover and the holding part; the button is slidably connected in the slide hole; the ejector pin is hung in the sleeve; the first spring is located between the ejector pin and the inner cover; the button is connected to the engaging head; a side of the plug housing provided with the insertion sheet is provided with an ejector pin hole for the ejector pin to go through; one end of the button is arranged on a socket housing in a penetrating manner.

2. The pop-up plug having the modularized plug separation mechanism of claim 1, wherein the engaging head and the button are distributed on both sides of the ejector pin along a radial direction.

3. The pop-up plug having the modularized plug separation mechanism of claim 1, wherein the at least one ejector pin control mechanism further comprises a barb and a hook part disposed on the ejector pin and matched with the barb; the engaging head and the barb are distributed on two sides of the ejector pin; the barb is hinged on the plug housing or the sleeve and is configured to swing when driven by the button.

4. The pop-up plug having the modularized plug separation mechanism of claim 1, wherein the engaging head is fixed to the button, and when the button is pressed, the engaging head performs a translational movement.

5. The pop-up plug having the modularized plug separation mechanism of claim 1, wherein the pop-up plug having the modularized plug separation mechanism includes two ejector pin control mechanisms; the buttons of the two ejector pin control mechanisms are distributed on both sides of the ejector pin; the two ejector pin control mechanisms share the second spring.

6. The pop-up plug having the modularized plug separation mechanism of claim 5, wherein an inner end of the button of one of the two ejector pin control mechanisms is provided with a slide slot extending from an inner end face in a pressing direction of the button, and an inner end of the button of the other ejector pin control mechanism is slidably connected in the slide slot; the second spring is located in the slide slot and extends along an extending direction of the slide slot; and two ends of the second spring are respectively connected to the buttons of the two ejector pin control mechanisms.

7. The pop-up plug having the modularized plug separation mechanism of claim 1, wherein an inner end of the ejector pin is provided with a spring installation hole extending along an extending direction of the ejector pin, and the first spring is arranged in the spring installation hole in a penetrating manner.

8. The pop-up plug having the modularized plug separation mechanism of claim 1, wherein an L-pole on/off control switch is disposed inside the plug housing; the L-pole on/off control switch comprises a first contact point, a second contact point, a commutator block, a permanent magnet and a conductive block slidably connected between the first contact point and the second contact point; the conductive block is connected to the second contact point by a conductive spring; the conductive block is hinged to a conductive arm; the first contact point is connected to the L-pole insertion sheet in the insertion sheet; the second contact point is configured to lead a power cord to the plug from a power source; the permanent magnet is configured to attach the conductive arm to the first contact point; the conductive arm is connected to the ejector pin by a cable supported on the commutator block; when the engaging head is engaged with the engaging part together, the conductive arm is connected to the first contact point; when the ejector pin moves toward the outside of the plug housing from a position fixed by the engaging head engaged with the engaging part, the ejector pin pulls the conductive arm away from the first contact point by the cable.

9. The pop-up plug having the modularized plug separation mechanism of claim 1, wherein the inner cover is provided with a limit pin arranged in an end of the first spring away from the ejector pin in a penetrating manner.

10. The pop-up plug having the modularized plug separation mechanism of claim 2, wherein the engaging head and the button are distributed on both sides of the ejector pin along a radial direction.

11. The pop-up plug having the modularized plug separation mechanism of claim 2, wherein the at least one ejector pin control mechanism further comprises a barb and a hook part disposed on the ejector pin and matched with the barb; the engaging head and the barb are distributed on two sides of the ejector pin; the barb is hinged on the plug housing or the sleeve and is configured to swing when driven by the button.

12. The pop-up plug having the modularized plug separation mechanism of claim 2, wherein the engaging head is fixed to the button, and when the button is pressed, the engaging head performs a translational movement.

13. The pop-up plug having the modularized plug separation mechanism of claim 2, wherein the pop-up plug having the modularized plug separation mechanism includes two ejector pin control mechanisms; the buttons of the two ejector pin control mechanisms are distributed on both sides of the ejector pin; the two ejector pin control mechanisms share the second spring.

14. The pop-up plug having the modularized plug separation mechanism of claim 2, wherein an inner end of the ejector pin is provided with a spring installation hole extending along an extending direction of the ejector pin, and the first spring is arranged in the spring installation hole in a penetrating manner.

15. The pop-up plug having the modularized plug separation mechanism of claim 2, wherein an L-pole on/off control switch is disposed inside the plug housing; the L-pole on/off control switch comprises a first contact point, a second contact point, a commutator block, a permanent magnet and a conductive block slidably connected between the first contact point and the second contact point; the conductive block is connected to the second contact point by a conductive spring; the conductive block is hinged to a conductive arm; the first contact point is connected to the L-pole insertion sheet in the insertion sheet; the second contact point is configured to lead a power cord to the plug from a power source; the permanent magnet is configured to attach the conductive arm to the first contact point; the conductive arm is connected to the ejector pin by a cable supported on the commutator block; when the engaging head is engaged with the engaging part together, the conductive arm is connected to the first contact point; when the ejector pin moves toward the outside of the plug housing from a position fixed by the engaging head engaged with the engaging part, the ejector pin pulls the conductive arm away from the first contact point by the cable.

* * * * *